US011596171B2

(12) United States Patent
Gnan

(10) Patent No.: US 11,596,171 B2
(45) Date of Patent: Mar. 7, 2023

(54) FILTER COMPONENT

(71) Applicant: PHILIP MORRIS PRODUCTS S.A., Neuchatel (CH)

(72) Inventor: Alessandro Gnan, Monte San Pietro (IT)

(73) Assignee: Philip Morris Products S.A., Neuchatel (CH)

( * ) Notice: Subject to any disclaimer, the term of this patent is extended or adjusted under 35 U.S.C. 154(b) by 239 days.

(21) Appl. No.: 16/604,684

(22) PCT Filed: Apr. 10, 2018

(86) PCT No.: PCT/EP2018/059201

§ 371 (c)(1),
(2) Date: Oct. 11, 2019

(87) PCT Pub. No.: WO2018/189201

PCT Pub. Date: Oct. 18, 2018

(65) Prior Publication Data

US 2020/0085095 A1 Mar. 19, 2020

(30) Foreign Application Priority Data

Apr. 14, 2017 (EP) ..... 17166683

(51) Int. Cl.
*A24D 3/17* (2020.01)
*A24D 3/06* (2006.01)
(Continued)

(52) U.S. Cl.
CPC ..... *A24D 3/065* (2013.01); *A24D 3/0229* (2013.01); *A24D 3/04* (2013.01); *A24D 3/063* (2013.01);
(Continued)

(58) Field of Classification Search
CPC ..... A24D 3/065; A24D 3/17; A24D 3/0229; A24D 3/04; A24D 3/063; A24D 3/067; A24D 3/10; A24D 3/14
See application file for complete search history.

(56) References Cited

U.S. PATENT DOCUMENTS 5,161,549 A * 11/1992 Rosario ..... A24D 3/14 131/331
10,064,429 B2 9/2018 Sebastian
(Continued)

FOREIGN PATENT DOCUMENTS

EP 2 671 461 12/2013
JP 2014-526277 10/2016
(Continued)

OTHER PUBLICATIONS

Coresta, Technical Report, Mar. 2011, Hardness Measurement on Cigarettes and Cigarette Filter Rods, Stephane Colard, 9 pages. (Year: 2011).*

(Continued)

*Primary Examiner* — Linda L Gray
(74) *Attorney, Agent, or Firm* — Mueting Raasch Group

(57) ABSTRACT

The present invention relates to a filter component comprising a plug of filter material comprising a body of a first filtering material and at least one element of a second filtering material, wherein the at least one element of the second filtering material is inserted in the body of a first filtering material, and wherein a volume ratio between a volume of the at least one element of a second filtering material and a volume of the plug is comprised between about 0.3 and about 0.8.

19 Claims, 6 Drawing Sheets

(51) Int. Cl.

| | |
|---|---|
| ***A24D 3/02*** | (2006.01) |
| ***A24D 3/04*** | (2006.01) |
| ***A24D 3/10*** | (2006.01) |
| ***A24D 3/14*** | (2006.01) |

(52) U.S. Cl.
CPC ..... *A24D 3/067* (2013.01); *A24D 3/10* (2013.01); *A24D 3/14* (2013.01); *A24D 3/17* (2020.01)

(56) References Cited

U.S. PATENT DOCUMENTS

| | | | |
|---|---|---|---|
| 10,555,553 | B2 | 2/2020 | Binassi |
| 2009/0288669 | A1 | 11/2009 | Hutchens |
| 2009/0288672 | A1 | 11/2009 | Hutchens |
| 2013/0312778 | A1 | 11/2013 | Shibuichi |
| 2016/0106147 | A1* | 4/2016 | Lisan ..... A24D 3/0275 131/341 |

FOREIGN PATENT DOCUMENTS

| | | |
|---|---|---|
| JP | 2017-509327 | 4/2017 |
| WO | WO 2009/143338 | 11/2009 |
| WO | WO 2012/105453 | 8/2012 |
| WO | WO 2013/098957 | 7/2013 |
| WO | WO 2016/135501 | 9/2016 |

OTHER PUBLICATIONS

PCT Search Report and Written Opinion for PCT/EP2018/189201 dated Jul. 24, 2018 (14 pages).
Office Action issued in Japan for Application No. 2019-546021 dated May 18, 2022 (12 pages). English translation included.

* cited by examiner

FILTER COMPONENT

This application is a U.S. National Stage Application of International Application No. PCT/EP2018/059201 filed Apr. 10, 2018, which was published in English on Oct. 18, 2018 as International Publication No. WO 2018/189201 A1. International Application No. PCT/EP2018/059201 claims priority to European Application No. 17166683.7 filed Apr. 14, 2017.

The present invention relates to a filter component. Said filter component is preferably used in an aerosol-forming article.

Filter components may be of different kind and purposes. They generally work modifying particulate phases by particle retention, modifying gaseous phases by adsorption or with a combination of both these mechanisms.

In aerosol-forming articles, such as cigarettes, filter components are typically placed at one end of the rod of tobacco in the filter.

The production of filter components starts from a filter material made of a mixture of various ingredients. The raw material for the manufacture of cigarette filters is commonly cellulose, for example obtained from wood. The cellulose is then acetylated, making it into a material called cellulose acetate or simply "acetate" for short, dissolved, and spun as continuous synthetic fibers arranged into a bundle generally called tow. This tow is generally opened, plasticized, shaped, and cut to length to act as a filter component. A plasticizer dissolves the cellulose acetate fibers so that they stick together in a single unit by the action of pressure and heat so that the filter material solidifies and the filter component is formed. Filters are commonly wrapped in a wrapping material, which in many cases includes a strip of a paper sheet.

Also the production of filters which are non-wrapped, is known. In the production of non-wrapped filters, the filter material is shaped in the desired form in a forming unit. The material used and the process of shaping are so realized that the filter component maintains its shape even after leaving the forming unit to a sufficient degree, so that the wrapping material—otherwise used for shape stabilization—can be omitted. During the production of non-wrapped filters, the filter material stream in the forming unit is subjected to pressure and heat. The necessary thermal energy can be introduced in various ways into the filter material, for example by hot-air, such as steam, or microwave energy.

In the context of the production of filter components made of cellulose acetate, an issue may be represented by the rate at which the filters biodegrade.

Depending on the environmental conditions where they are disposed, cellulose acetate filters can indeed take between one month and three years to biodegrade, which may not be sufficiently fast to avoid the issue of litter.

Alternative materials to acetate tow have been tested in order to substitute cellulose acetate, for example by crimped paper. Filter components comprising crimped paper instead of cellulose acetate were however not comparable in terms of filtration performance to filter components made by acetate tow.

In any case, the use of alternative materials for replacing cellulose acetate for producing filter components may require substantial modifications of manufacturing apparatuses and processes, with the connected increase of production costs.

There is therefore a need for a filter component having increased rate of biodegradation. There is also a need for filter components able to represent an alternative to traditional filter components made of cellulose acetate.

The invention may satisfy at least one of the above needs.

The invention relates to a filter component comprising a plug of filter material comprising a body of a first filtering material and at least one element of a second filtering material including cotton fibers, wherein the at least one element of the second filtering material is inserted in the body of a first filtering material, and wherein a volume ratio between a volume of the at least one element of a second filtering material and a volume of the plug is comprised between about 0.3 and about 0.8.

In the filter component of the invention said at least one element of a second filtering material is used into the plug of filter material so that it partially replaces the first filtering material. The first filtering material may be for example a synthetic filtering material, more advantageously comprising cellulose acetate. In such a way, the insertion of said element in the filter component of the invention, in such a relatively great amount of 30%-80% with respect to a volume of the plug in which is inserted, increases the surface area of the first filtering material per volume of filter element and may therefore speed the rate of biodegradation of the filter element. At the same time, a partial replacement of the first filtering material by the second filtering material may not require the implementation of substantial modifications of manufacturing apparatuses and processes, thus avoiding an increase of production costs.

Preferably, the filter component of the invention is used in an aerosol forming article.

In the following, the term "rod" denotes a generally cylindrical element of substantially circular, oval or elliptical cross-section, comprising two or more components of an aerosol forming article.

Aerosol forming articles according to the present invention may be in the form of filter cigarettes or other smoking articles in which tobacco material is combusted to form smoke. The present invention additionally encompasses articles in which tobacco material is heated to form an aerosol, rather than combusted, and articles in which a nicotine-containing aerosol is generated from a tobacco material, tobacco extract, or other nicotine source, without combustion or heating. These articles in which aerosol is formed without combustion or where smoke is produced by combustion are in general called "aerosol-forming articles". Aerosol forming articles according to the invention may be whole, assembled aerosol forming articles or components of aerosol forming articles that are combined with one or more other components in order to provide an assembled article for producing an aerosol, such as for example, the consumable part of a heated smoking device.

As used herein, aerosol forming article is any article that generates an inhalable aerosol when an aerosol forming substrate is heated. The term includes articles that comprise an aerosol forming substrate that is heated by and external heat source, such as an electric heating element. An aerosol forming article may be a non-combustible aerosol forming article, which is an article that releases volatile compounds without the combustion of the aerosol-forming substrate. An aerosol forming article may be a heated aerosol forming article, which is an aerosol forming article comprising an aerosol forming substrate that is intended to be heated rather than combusted in order to release volatile compounds that can form an aerosol. The term includes articles that comprise an aerosol forming substrate and an integral heat source, for example a combustible heat source.

An aerosol forming article may be an article that generates an aerosol that is directly inhalable into a user's lungs through the user's mouth. An aerosol forming article may resemble a conventional smoking article, such as a cigarette and may comprise tobacco. An aerosol forming article may be disposable. An aerosol forming article may be partially-reusable and comprise a replenisheable or replaceable aerosol forming substrate.

An aerosol forming article may also include a combustible cigarette. In preferred embodiments, the aerosol forming-article may be substantially cylindrical in shape. The aerosol forming article may be substantially elongated. The aerosol forming article may have a length and a circumference substantially perpendicular to the length. The aerosol forming article may have a total length between approximately about 30 millimeters and approximately about 100 millimeters. The aerosol forming article may have an external diameter between approximately about 5 millimeters and approximately about 12 millimeters.

The filter component of the invention thus includes a plug having a body of a first filtering material. This first filtering material is preferably a "standard" material used in filter plugs. Inside this first filtering material, another element made in a different second filtering material is inserted.

Preferably, the body of first filtering material has a rod shape.

The body may be a continuous rod of filter tow, thus a continuous filter rod, or individual filter rod segments, for example a plurality of filter rods one attached to the other in which the element is inserted. Preferably, a continuous filter rod is provided from a rod forming device.

The element inserted in the rod can be a continuous element as well or a plurality of element one subsequent to the others.

The ratio between the volumes of the element and of the plug is preferably comprised between about 0.3 and about 0.8, preferably between about 0.35 and about 0.7, more preferably between about 0.4 and about 0.65, even more preferably between about 0.45 and about 0.65, and preferably is of about 0.6 or of about 0.5. Due to the fact that a large part of the total volume of the plug is realized in the second filtering material, the use of the first filtering material is therefore limited and its surface area per volume of filter element is increased by the insertion of the element of the second filtering material.

With volume of the plug, the combined volume of the body of the first filtering material and the element of the second filtering material is meant.

Further, the element realized in the second filtering material may be coloured so as to give a different visual look at the aerosol forming article or it could be flavoured to change the smoking experience depending on the flavour used. For this, the second filtering material may have adsorption properties.

Within the body of said first filtering material, said at least one element may have any shape and may extend in any direction. Preferably, said at least one element may advantageously extend in a longitudinal direction between a first and a second axially opposed faces of said body of a first filtering material. Thus, preferably, the body and the element inserted therein may have the same length, however a shorter or longer element with respect to the body may be envisaged as well.

The body may be a filter rod as known in the art. The body may be a hollow filter rod, for example in the form of a hollow tube. The element in the second filtering material is thus inserted in the hole defined by the hollow tube.

Preferably, the ratio between the transversal dimension defined by said at least one element and the corresponding transversal dimension of said plug is comprised between about 0.55 to about 0.89 said transversal dimension being in a direction transversal with respect to a side face of said body substantially perpendicular to at least one of said first and second axially opposed faces of said body. More preferably the ratio between the transversal dimension defined by said at least one element and the corresponding transversal dimension of said plug is comprised between about 0.59 and about 0.83, even more preferably between about 0.63 and about 0.8, still even more preferably between about 0.67 and about 0.77. In other words, the element inserted within the body is relatively "thick". The trasversal dimension, in case of "cylindrical" plugs, may be considered as the diameter of the cylinder. Thus, the considered ratio is the ratio between the diameter of the element and the diameter of the plug. The diameter of the plug is the diameter of the element and the body together.

Preferably, said at least one element extends in a direction which is substantially parallel to a side face of body of first filtering material. In the filter component of the invention, when said at least one element extend in a longitudinal direction between said first and second axially opposed faces of said body of a first filtering material, the element extends in a direction which may be parallel or not to said side face of said body. Preferably, said at least one element extends in a direction which is substantially parallel to said side face of said body of a first filtering material so that, in the direction of air travelling through the filter component during smoking, the resistance may be substantially uniform. If the body has a rod shape, the side surface is a cylindrical mantle and the element may extend along the axis of the cylinder defined by the body.

Preferably, said at least one element extends through substantially the center of said body of a first filtering material. This may lead to a uniform resistance to air.

Preferably, at least one end of said at least one element extends flush with the corresponding face of said body of a first filtering material. The body and the element thus form geometrically a single surface on both their ends. The length of the element and the body is thus preferably the same. Alternatively, said body is an hollow body and said at least one element protrudes from at least one of said first and second axially opposed faces of said body of a first filtering material. The one element may be inserted so that it is visible from the two opposite axial sides of the body. In said body of a first filtering material, more than one element of a second filtering material may be inserted; each of them may have any shape and may extend in any direction, as disclosed above. Preferably, into said body of a first filtering material said at least one element of a second filtering material is one continuous element.

The second filtering material which is used to realize said at least one element may include, in addition to cotton fibers, any other suitable material or materials. Preferably, the second filtering material includes vegetable fibers different from cotton fibers. More preferably, the vegetable fibers different from cotton fibers comprise paper fibers, polylactic acid fibers and any combination thereof.

Preferably, the second filtering material comprises more than about 20 percent, more preferably from about 25 percent by weight to about 95 percent by weight of cotton fibers, relative to the total weight of the second filtering material.

Preferably, said at least one element is in form of a yarn. As used herein, the term "yarn" or "thread" indicates a fiber or a plurality of fibers twisted together or laid parallel to form a woven, weaved, glued, twisted, plaited or otherwise associated continuous element. A yarn may be used herein to form a strand, a wire, a string, a cord, a twine, a filament, a braid or a rope.

Preferably, said at least one element comprises a cotton yarn.

Said material or materials used to realize said at least one element may be woven, weaved, glued, twisted, plaited or otherwise associated to form it.

Preferably, the element of second filtering material has a hardness comprised between about 40 percent and about 60 percent. More preferably, the hardness of the element is comprised between about 45 percent and about 55 percent.

The term "hardness" used throughout this specification denotes the resistance to deform. Hardness is generally expressed as a percentage. In the following the description on how to calculate the hardness according to the invention is given. WO2015/124242 and WO 2015/007400 describe possible ways to measure the hardness according to the invention. FIG. 1 shows a cigarette 101 before applying a load F and the same cigarette 103 whilst applying load F. The cigarette 101 before load F has been applied has a diameter Ds. The cigarette 103 after applying a set load for a set duration (but with the load still applied) has a (reduced) diameter Dd. The depression is d=Ds−Dd. Referring to FIG. 1, hardness is given by:

$$\text{hardness}(\%) = \frac{D_d}{D_s} * 100\%$$

where Ds is the original (undepressed) cigarette diameter, and Dd is the depressed diameter after applying a set load for a set duration. The harder the material, the closer the hardness is to 100%.

As is described in more detail below, and generally known in the art, to determine the hardness of a portion (such as a filter) of a smoking article, smoking articles should be aligned parallel in a plane and the same portion of each smoking article to be tested should be subjected to a set load for a set duration. This test is performed using a known DD60A Densimeter device (manufactured and made commercially available by Heinr. Borgwaldt GmbH, Germany), which is fitted with a measuring head for cigarettes and with a cigarette receptacle.

The load is applied using two load applying cylindrical rods, which extend across the diameter of all of the smoking articles at once. According to the standard test method for this instrument, the test should be performed such that twenty contact points occur between the smoking articles and the load applying cylindrical rods. In some cases, the filters to be tested may be long enough such that only ten smoking articles are needed to form twenty contact points, with each smoking article contacting both load applying rods (because they are long enough to extend between the rods). In other cases, if the filters are too short to achieve this, then twenty smoking articles should be used to form the twenty contact points, with each smoking article contacting only one of the load applying rods, as further discussed below.

Two further stationary cylindrical rods are located underneath the smoking articles, to support the smoking articles and counteract the load applied by each of the load applying cylindrical rods. Such an arrangement is described in more detail below, and shown in FIGS. 2 to 4.

For the standard operating procedure for such an apparatus, an overall load of 2 kilograms is applied for a duration of 20 seconds. After 20 seconds have elapsed (and with the load still being applied to the smoking articles), the depression in the load applying cylindrical rods is determined, and then used to calculate the hardness from the above equation. The temperature is kept in the region of 22 degrees Centigrade±2 degrees. The test described above is referred to as the DD60A Test. The DD60A Test and corresponding apparatus are described in more detail below in relation to FIGS. 2 to 4. As discussed in more detail below, the hardness of a filter portion of a smoking article does not greatly differ when the smoking article is smoked rather than unsmoked. However, the standard way to measure the filter hardness is when the smoking article is unsmoked. The same measuring principle as disclosed above may be applied to determine the hardness of the element of second filtering material, of the body of first filtering material and of the filter component of the invention.

The first filtering material which is used to realize said body of the filter component of the invention may comprise any suitable material or materials. Preferably, the first filtering material includes synthetic filtering materials. More preferably, the synthetic filtering material is selected from the group consisting of cellulose acetate, cellulose, reconstituted cellulose, polylactic acid, polyvinyl alcohol, nylon, polyhydroxybutyrate, polypropylene, paper, thermoplastic material, such as starch, non-woven materials and combinations thereof. One or more of the materials may be formed into an open cell structure. Preferably, the first filtering material comprises a synthetic filtering material that comprises cellulose acetate.

The first filtering material may have any suitable structure. For example, the first filtering material may comprise a gathered sheet of material comprising polylactic acid. However, preferably the first filtering comprises a plurality of fibres formed at least in part from polylactic acid. Fibres are a particularly effective form of filtering material as they can provide tortuous passageways through which aerosol can pass. Furthermore, when an aerosol forming article is discarded after use, the fibres may degrade and disperse more readily than other structures, thus helping to improve the degradation properties of the mouthpiece or aerosol generating article.

Preferably, the fibres are substantially unconnected to one another. That is, preferably no additive is included in the body for binding the fibres together. This can help to improve the rate at which the fibres can degrade and disperse when an aerosol forming article is discarded after use.

Preferably, the first filtering material is a blend comprising polylactic acid and at least one other polymer. The additional polymer or polymers may provide additional properties to the first filtering material. For example, the additional polymers can provide the first filtering material with additional tensile strength and elasticity properties. Where the first filtering material comprises a plurality of fibres made of a blend of different polymers, this can enable the fibres to be processed on the same machinery that is typically used for manufacture of cellulose acetate filters, at a speed typically associated with the manufacture of cellulose acetate filters, and with a comparable waste percentage and operational efficiency.

Preferably the first filtering material comprises at least about 70 percent polylactic acid by weight, more preferably at least about 80 percent polylactic acid by weight, and even more preferably about 85 percent polylactic acid by weight.

Preferably, said body of first filtering material has a hardness comprised between about 40 percent and about 60 percent, more preferably between about 45 percent and about 55 percent.

The filter component may include additional material. For example, the additional material may be incorporated into the first filtering material or in an additional component of the plug of filter material. For example, the filter component may include a sorbent material. The term "sorbent" refers to an adsorbent, an absorbent, or a substance that may perform both of these functions. The sorbent material may comprise activated carbon. The sorbent may be incorporated into the first filtering material or in the at least one element of a second filtering material. More preferably, however, the sorbent is incorporated into an additional filter component upstream or downstream of the filter component of the invention.

Preferably, said filter component includes a wrapping material and wherein the plug of filter material is overwrapped by the wrapping material. More preferably, the wrapping material comprises at least one sheet of paper. The wrapping material overwrapping the plug of filter material has the function of shape stabilization of the filter component after it production.

Preferably, the first filtering material comprises at least one plasticizer. Preferably, the plasticizer has the function of a bonding constituent. In unwrapped filters element, the density or stiffness of the filter materials needs to be higher than in standard wrapped filters elements due to the fact that there is no restraint action by the wrapping paper on the filter material. The plug of filter material therefore, when formed in a rod-like shape, needs to keep a well-defined shape, with a substantially fixed diameter, without the aid of any additional external material.

Alternatively or additionally, the filter component may include at least one adhesive, at least one flavor release agent, at least one dye or a combination thereof. Different functions besides filtering can be obtained using the filter component of the invention.

Preferably, said filter component has a hardness comprised between about 75 percent and about 92 percent, more preferably about 80 percent.

The filter component of the invention may be used alone or associated with other filter components, which may be the same or different, in filter for aerosol-forming articles, such as cigarettes.

The filter component of the invention may be approximately about 7 millimeters in length in one embodiment, but may have a length of between approximately about 5 millimeters and approximately about 20 millimeters.

Filters elements of the invention may advantageously be used in aerosol-forming articles. Aerosol-forming articles according to the present invention may be in the form of filter cigarettes or other smoking articles in which tobacco material is combusted to form smoke. The present invention additionally encompasses articles in which tobacco material is heated to form an aerosol, rather than combusted, and articles in which a nicotine-containing aerosol is generated from a tobacco material, tobacco extract, or other nicotine source, without combustion or heating. These articles in which aerosol is formed without combustion or where smoke is produced by combustion are in general called "aerosol-forming articles". Aerosol-forming articles according to the invention may be whole, assembled aerosol-forming articles or components of aerosol-forming articles that are combined with one or more other components in order to provide an assembled article for producing an aerosol, such as for example, the consumable part of a heated smoking device.

Disclosed is also herein an apparatus for producing a filter component, said apparatus comprising:

- a first feed path adapted to continuously feed at least one layer of a first filtering material along a first longitudinal transport direction;
- a second feed path adapted to continuously feed at least one strand comprising at least one thread of a second filtering material along a second longitudinal transport direction, preferably intersecting said first longitudinal direction;
- an aligning element connected to a terminating end of said first feed path and to a corresponding terminating end of said second feed path, wherein said aligning element is adapted to collect said at least one layer and said at least one strand and to allow said at least one layer to incorporate said at least one strand in such a way to form a rod of filter material including a sheath of a first filtering material incorporating at least one element of at least a second filtering material;
- a forming device positioned at a point downstream to said aligning device, wherein said forming device is adapted to form the rod of filter material into a plug of filter material comprising a body of first filtering material and at least one element of a second filtering material, in such a way that said at least one element is inserted in the body of a first filtering material and that a volume ratio between a volume of the at least one element of a second filtering material and a volume of the plug is comprised between about 0.3 and about 0.8.

The advantages of this apparatus have been already outlined with reference to the above filter component and are not repeated herewith.

Upstream to said first and/or second feed path, the apparatus preferably includes at least one supply means adapted to withdraw said at least one layer of a first filtering material and/or said at least one strand comprising at least one thread of a second filtering material.

Preferably, the first feed path and/or the second feed path comprise one or more pairs of rolls, that are adapted to allow said at least one layer and/or said at least one thread to pass therethrough.

Preferably, the first feed path and the second feed path intersect at an inlet of the aligning element. Preferably, the apparatus includes one or more rolls that are adapted to convoy said at least one layer and/or said at least one thread to said aligning device.

The aligning device preferably comprises a collecting element, preferably of substantially annular or elliptical cross-section, adapted to allow said at least one layer and said at least one strand to pass therethrough in such a way that said at least one strand is sheathed by said at least one layer, in order to incorporate the former.

In a preferred embodiment, said collecting element is adapted to cooperate with said first feed path and said second feed path in such a way that said at least one strand is coaxially sheathed by said at least one layer. In such a way, in the resulting filter component the at least one element of a second filtering material is incorporated in the body of a first filtering material in such a way to extend in a longitudinal direction between a first and a second axially opposed faces of said body.

Preferably, said collecting element is adapted to cooperate with said first feed path and said second feed path in such a way that said at least one strand is evenly sheathed by said layer. In such a way that in the resulting body of a first filtering material said at least one element extends through substantially the center of said body.

Preferably, the forming device is adapted to form the rod of filter material into a plug of filter material comprising a body of first filtering material and at least one element of a second filtering material, in such a way that said at least one element is inserted in the body of a first filtering material and that a volume ratio between a volume of the at least one element of a second filtering material and a volume of the plug is comprised between about 0.35 and about 0.7, more preferably between about 0.4 and about 0.65, even more preferably between about 0.45 and about 0.65, and preferably is of about 0.6 or of about 0.5.

Preferably, the forming device comprises internal walls that define an internal channel preferably of substantially circular cross section, along a longitudinal axis connecting an inlet of the forming element to an outlet of the same, said internal channel being adapted to allow said rod of filter material to pass therethrough in such a way to define a side face of said body of a first filtering material.

The internal channel defined by the internal walls of the forming device defining a side face of the plug of filter material preferably determine, among others, the ratio between the transversal dimension defined by the at least one element of a second filtering material and the corresponding transversal dimension of the body of a first filtering material, said transversal dimension being in a direction transversal with respect to said side face. In a preferred embodiment, said internal channel is adapted to determine a ratio between the transversal dimension defined by said at least one element and the corresponding transversal dimension of said plug comprised between about 0.55 to about 0.89, more preferably between about 0.59 and about 0.83, even more preferably between about 0.63 and about 0.8, still even more preferably between about 0.67 and about 0.77.

The forming device preferably includes a heat-treating section, advantageously connected to the internal channel, adapted to heat a rod of filter material while it passes through said internal channel and to form it into said plug of filter material.

Said heat-treating section may comprise any heat-generating element, for example it may advantageously comprise a steam generator fluidly connected to said internal channel to supply steam to the rod of filter material while it passes therethrough said internal channel. By means of the heat released for example by said steam generator to the rod of filter material, said rod is heated and formed it into a plug of filter material.

Downstream to said heat-treating section the forming device preferably comprises a cooling section, adapted to cool down the plug of filter material.

Preferably, downstream to said heat-treating section said forming device includes a cutting station adapted to cut said plug of filter material in such a way that said plug has a first and a second axially opposed faces at least one of which is substantially perpendicular to the side face of the body of synthetic filtering material, as it is defined by the internal channel along the longitudinal axis connecting an inlet of the forming device to an outlet of the same.

Preferably, said cutting station is adapted to cut the plug of filter material in such a wat that said at least one element extends flush with the corresponding face of said body of a first filtering material. Preferably, said cutting station is adapted to cut said plug of filter material in such a way that said at least one element protrudes from at least one of said first and second axially opposed faces of said body of a first filtering material.

The apparatus may include additional elements. For example, the apparatus may include one or more suction openings for generating a negative pressure causing the layer and the strand to move towards the aligning device and the rod of filter material to the forming device. In this way, a speed or acceleration can be imparted to the layer, the strand and the rod at least for a given time.

Preferably, the apparatus includes at least one speed regulating mean preferably connected to a sensor system adapted to measure the speed of the objects moving into the apparatus. Preferably, this speed regulating mean is adapted to reciprocally regulate the feed rate of the strand and of the layer of a first filtering material to the aligning device. In this way, the first feed path adapted to continuously feed at least one layer of a first filtering material along a first longitudinal transport direction and the second feed path adapted to continuously feed at least one strand of a second filtering material along a second longitudinal transport direction are adapted to cooperate with the aligning device in such a way that said layer incorporate said strand.

Preferably, the apparatus includes one or more dosing stations adapted to dose one or more additives that may be added to the filter component or to its components. For example, the apparatus of the invention may include a plasticizer dosing station upstream to said forming device and adapted to dose at least one plasticizer to add said plasticizer to the first filtering material. Said plasticizer for example may dissolve the cellulose acetate fibers used as first filtering material so that they stick together in a single unit.

Preferably, the apparatus includes a flavor release agent dosing station, preferably upstream or with forming device, adapted to dose at least one flavor release agent to add said flavor release agent to the filter material.

Preferably, the apparatus includes a dye dosing station, preferably upstream or with forming device, adapted to dose at least one dye to add said dye to the filter material.

Preferably, the apparatus includes a wrapping station, preferably included in or downstream to said aligning device, adapted to wrap a wrapping material over the rod of filter material.

The apparatus preferably includes a third feed path adapted to feed the wrapping material to the wrapping station along a third longitudinal transport direction. The third feed path preferably comprises one or more rolls, adapted to convoy the wrapping material to the wrapping station.

Upstream to said third feed path, the apparatus preferably includes a bobbin to withdraw the wrapping material, when the same is in form of a sheet.

Disclosed is also herein a method for producing a filter component, said method comprising:

i. providing at least one layer of a first filtering material;
ii. providing at least one strand of a second filtering material;
iii. collecting said at least one layer and said at least one strand;
iv. incorporating said at least one strand into said at least one layer in such a way to form a rod of filter material comprising a sheath of a first filtering material incorporating at least one element of a second filtering material;
v. forming said rod of filter material into a plug of filter material comprising a body of a first filtering material and at least one element of a second filtering material, in such a way that said at least one element is inserted in the body of a first filtering material and that a volume ratio between a volume of the at least one element of a second filtering material and a volume of the plug is comprised between about 0.3 and about 0.8.

The advantages of this method have been already outlined with reference to the above filter component and apparatus and are not repeated herewith.

Preferably, in order to incorporate said at least one strand, in step iv. of the process of the invention the same is sheathed by said at least one layer. Said folding around is preferably performed in such a way that said at least one strand is coaxially sheathed by said at least one layer. In such a way, in the resulting filter component the at least one element of a second filtering material is incorporated in the body of a first filtering material in such a way to extend in a longitudinal direction between a first and a second axially opposed faces of said body.

Preferably, in step iv. of the process of the invention said at least one strand is evenly sheathed by said at least one layer. In such a way that in the resulting body of a first filtering material said at least one element extends through substantially the center of said body of a first filtering material.

Preferably, the process of the invention comprises the dosing of one or more additives that may be added to the filter component. For example, step forming comprises adding at least one plasticizer to the first filtering material. As above disclosed, a plasticizer has the function of a bonding constituent, which is particularly suitable in non-wrapped filters element, in which, as mentioned, the density or stiffness of the filter materials needs to be higher than in standard wrapped filters elements due to the fact that there is no restraint action by the wrapping paper on the filter material.

The process of the invention may preferably comprise adding at least one sorbent material, preferably activated carbon. The sorbent may be added for example to the first filtering material or to the second filtering material.

Depending on the desired properties and characteristics of the filter component, the process of the invention may preferably comprise adding at least one flavor release agent to the first filtering material and/or adding at least one dye to the first filtering material.

Preferably, said step v. of the process of the invention comprises forming said rod of filter material into a plug of filter material comprising a body of a first filtering material and at least one element of a second filtering material, in such a way that said at least one element is inserted in the body of a first filtering material and that a volume ratio between a volume of the at least one element of a second filtering material and a volume of the plug is comprised between about 0.35 and about 0.7, more preferably between about 0.4 and about 0.65, even more preferably between about 0.45 and about 0.65, and preferably is of about 0.6 or of about 0.5.

During said step v. of the process of the invention, a side face of the body of a first filtering material is preferably defined, for example by passing the rod obtained in step iv. through an internal channel, preferably of substantially circular cross section, defined along a longitudinal axis connecting an inlet of a forming element to an outlet of the same by means of its internal walls.

When defining said side face, it is possible with the method of the invention to determine the ratio between the transversal dimension defined by said at least one element and the corresponding transversal dimension of said body of a first filtering material, said transversal dimension being in a direction transversal with respect to a side face of said body. Preferably, in the process of the invention said step v. comprises determining a ratio between the transversal dimension defined by said at least one element and the corresponding transversal dimension of said plug comprised between about 0.55 to about 0.89, more preferably between about 0.59 and about 0.83, even more preferably between about 0.63 and about 0.8, still even more preferably between about 0.67 and about 0.77.

Step v. of the process of the invention preferably comprises heating the rod formed in step iv. to form said plug of filter material.

Said heat treatment may be performed by means of any known heat-generating element, for example it may advantageously be carried out by means of a steam generator to supply steam to the rod of filter material. By means of the heat released for the steam to the rod of filter material, said rod is heated and formed it into a plug of filter material.

Following said heat treatment, the process according to the invention preferably comprises one or more further treatments in order to bring the filter component into the desired final form. For example, the process according to the invention preferably comprises cooling down the plug of filter material.

Preferably, downstream to said heat treatment step v. comprises cutting said plug of filter material in such a way that said plug has a first and a second axially opposed faces, wherein at least one of said first and second axially opposed faces is substantially perpendicular to side face of said body.

Preferably, said cutting cuts said plug of filter material in such a way that said at least one element extends flush with the corresponding face of said body of a first filtering material.

Preferably, said cutting cuts said plug of filter material in such a way that said at least one element protrudes from at least one of said first and second axially opposed faces of said body of a first filtering material.

As above disclosed, the filter component may comprise a wrapping material, preferably comprising at least one sheet of paper, overwrapping the plug of filter material, which has the function of shape stabilization of the filter component even after it has left the forming unit.

Preferably, the process of the invention comprises the step of wrapping a wrapping material over the rod of filter material, said wrapping material preferably comprising at least one sheet of paper.

Specific embodiments of the invention will be further described, by way of example only, with reference to the accompanying drawings in which:

FIGS. 2, 3 and 4 illustrate the apparatus for testing the hardness of the smoking articles filters element of the invention, operating according to the principle depicted in FIG. 1.

Figure 1:
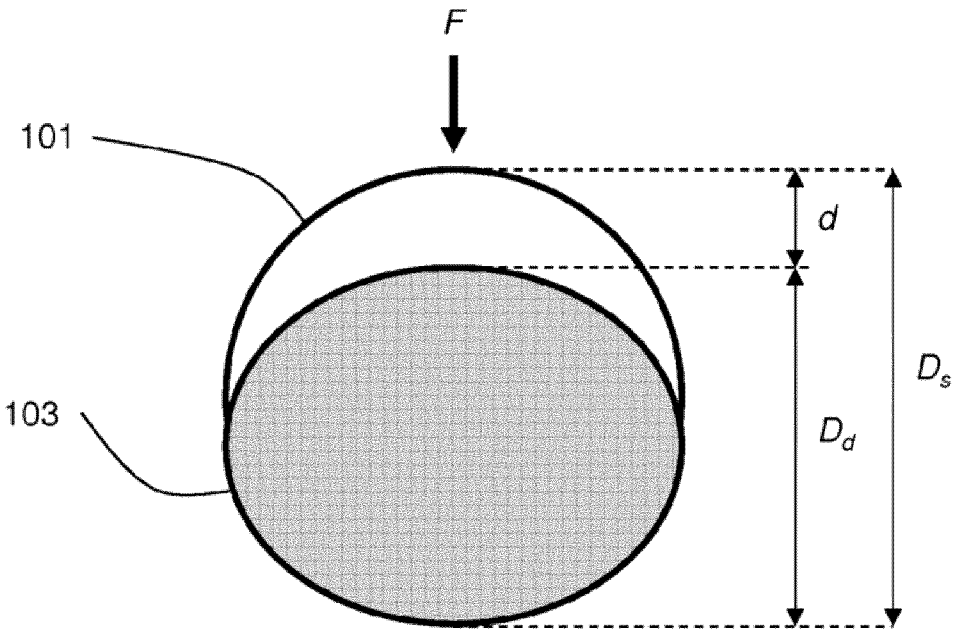
FIG. 1 illustrates a method for measuring the hardness used in the present invention.
Figure 2:
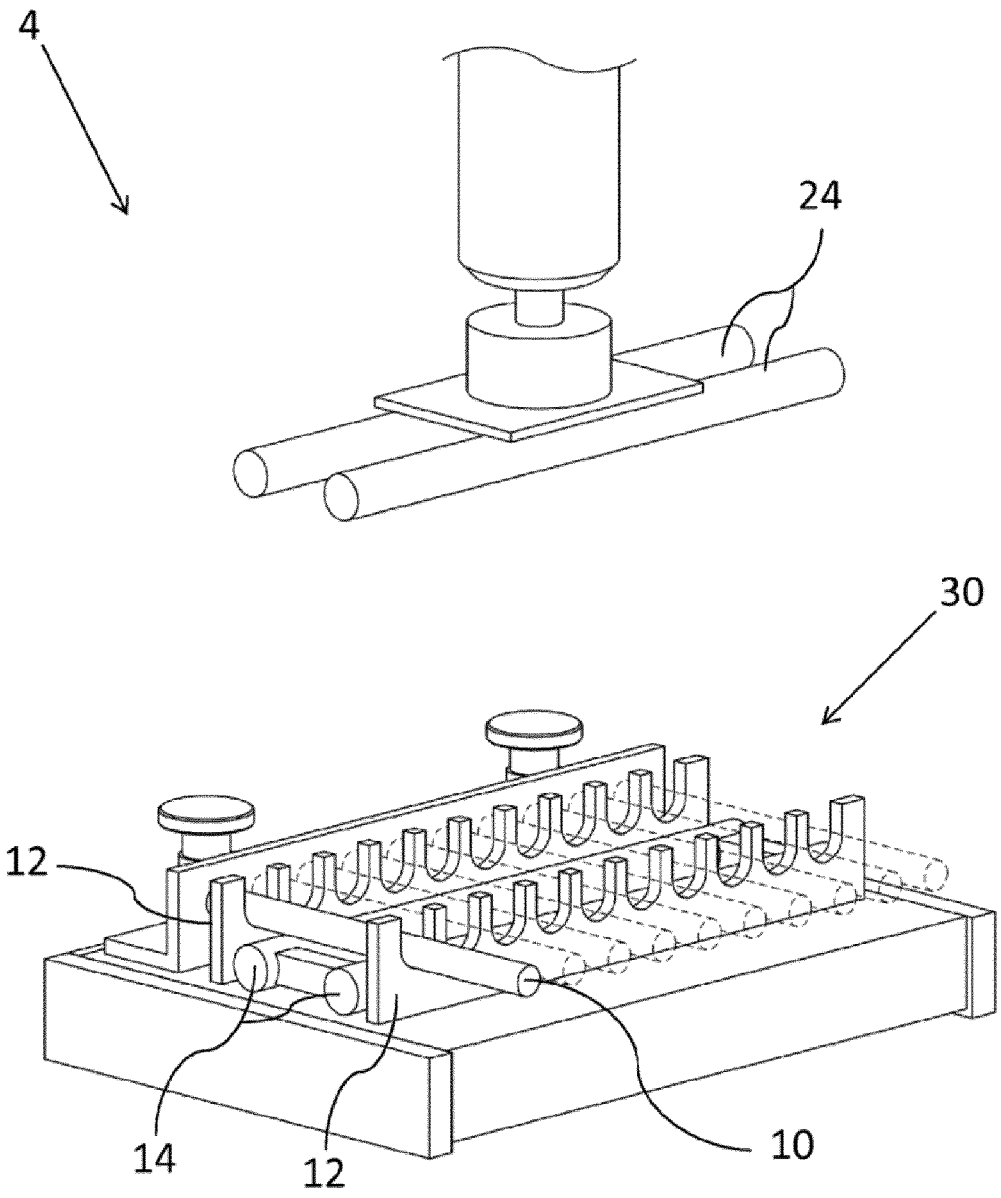
FIG. 2 is a perspective view of an apparatus for determining the hardness of a filter or a smoking article, in a first configuration.

FIG. 2 is a perspective view of an apparatus 4, such as a DD60A Densimeter device, for determining the hardness of a filter of a smoking article. The apparatus includes two parallel load applying rods 24 positioned over a support plate 30. The support plate 30 includes two parallel, spaced apart walls 12, with each wall 12 having ten equally spaced recesses. The recesses are arranged to prevent the smoking articles 10 from contacting one another during testing.

As can be seen in FIG. 2, ten identically designed smoking articles 10 are aligned parallel in a plane, and placed on underlying cylindrical rods 14. The smoking articles 10 extend between corresponding recesses in the walls 12 to hold the smoking articles in place. The underlying cylindrical rods 14 extend parallel to the walls 12. Each smoking article 10 contacts the underlying rods 14 at two points, making for twenty total points of contact between the smoking articles to be tested and the underlying rods 14.

To test the hardness of a smoking article's filter, the smoking articles should be positioned such that the portion of the filter to be tested is in contact with the underlying rods 14. If filter is too short and the portion of the filter to be tested either does not contact both rods or contacts the rods very close to the ends of the portion of the filter to be tested, then it would appreciated that this could be achieved by using twenty cigarettes in a back-to-back configuration, such as that shown in FIG. 3.

As shown, the concept of the DD60A Test is that the underlying cylindrical rods contact the sample material to be tested at twenty contact points. If the filter is sufficiently long to extend across the underlying rods, then the twenty contact points can be provided with ten samples (as shown in FIG. 2). If the filter is not sufficiently long, then the twenty contact points can be provided with twenty samples, as shown in FIG. 3.

Figure 3:
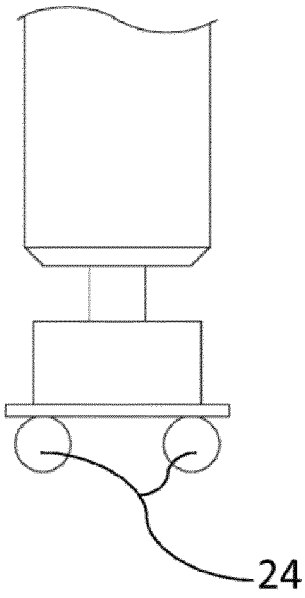
FIG. 3 is a side view of the apparatus of FIG. 2, in the first configuration.
Figure 3:
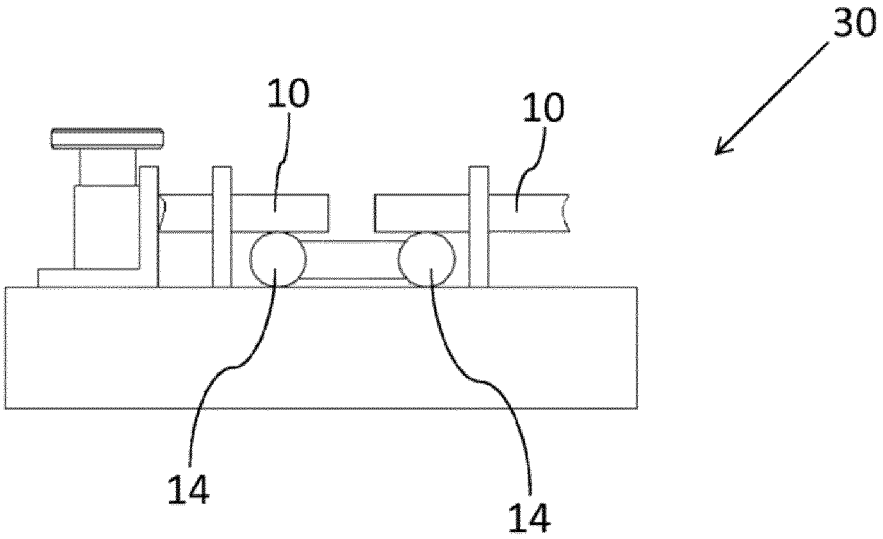

As can be seen in FIG. 3, portions of the tobacco rods have been removed from each smoking article 10, and the filter portion of each smoking article 10 rests on a respective cylindrical rod 14. In the present case, the hardness of the mouth end segment is being tested, and therefore it is this portion of the filter which rests on the rod 14, and the mouth end segment is approximately centered on the rods 14. If necessary, the tips of the smoking articles extending away from the cylindrical rods 14 may be supported by an underlying supporting means to prevent pivoting of the smoking articles.

Figure 4:
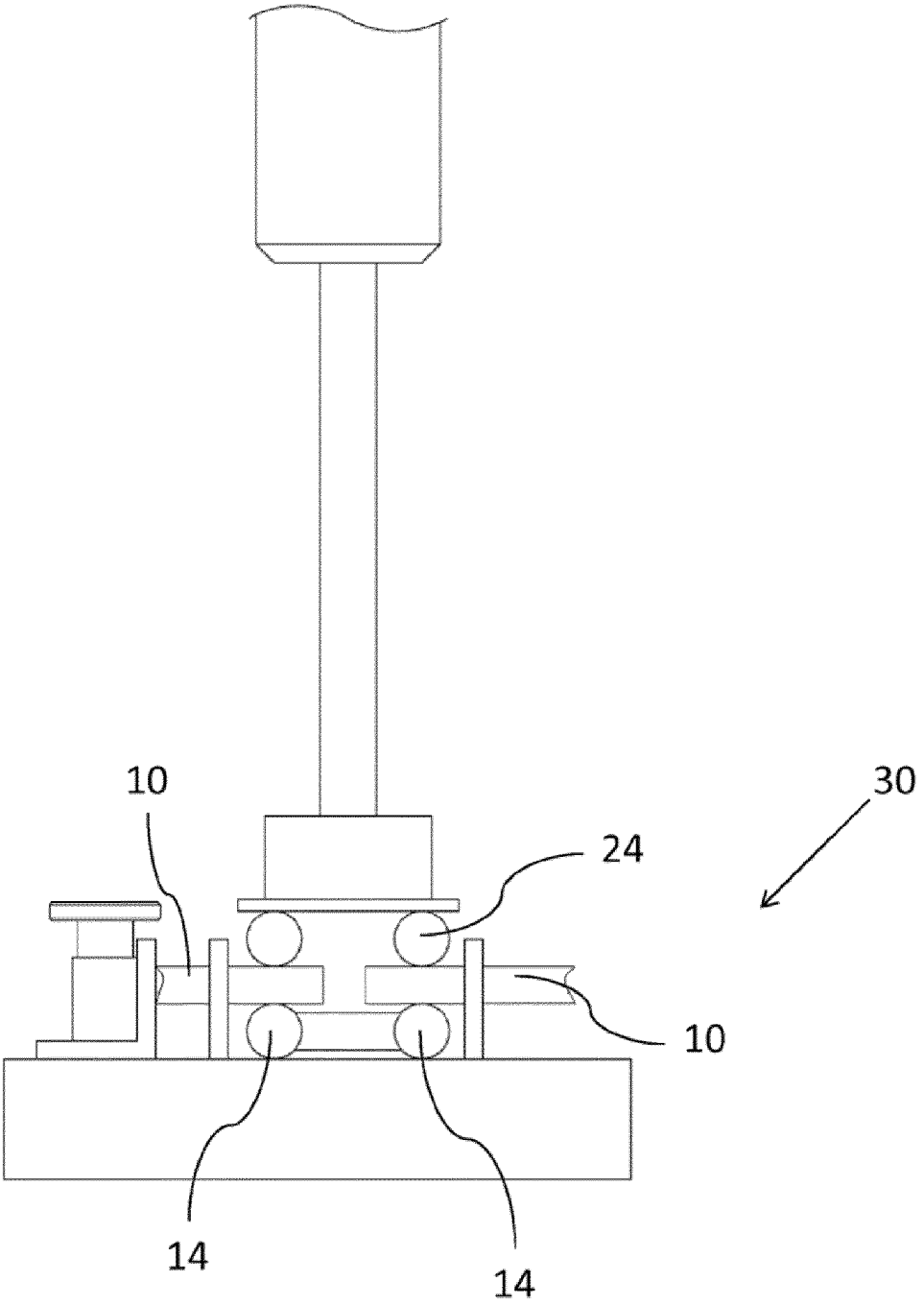
FIG. 4 is a side view of the apparatus of FIGS. 2 and 3, in a second configuration.

The apparatus is shown in FIG. 3 in a first configuration, in which the two load applying cylindrical rods 24 are raised above and out of contact from the smoking articles 10. To test the hardness of the smoking articles, the load applying cylindrical rods 24 are lowered to a second configuration, to come into contact with the smoking articles 10, as shown in FIG. 4. When in contact with the smoking articles 10, the load applying rods 24 impart an overall load of 2 kg across the twenty contact points of the smoking articles 10 for a duration of 20 seconds. After 20 seconds have elapsed (and with the load still being applied to the smoking articles), the depression in the load applying cylindrical rods 24 across the smoking articles is determined, and then used to calculate the hardness.

The above measurement is applied to the filter component, plug, body and element of the present invention, as described below.

Figure 6:
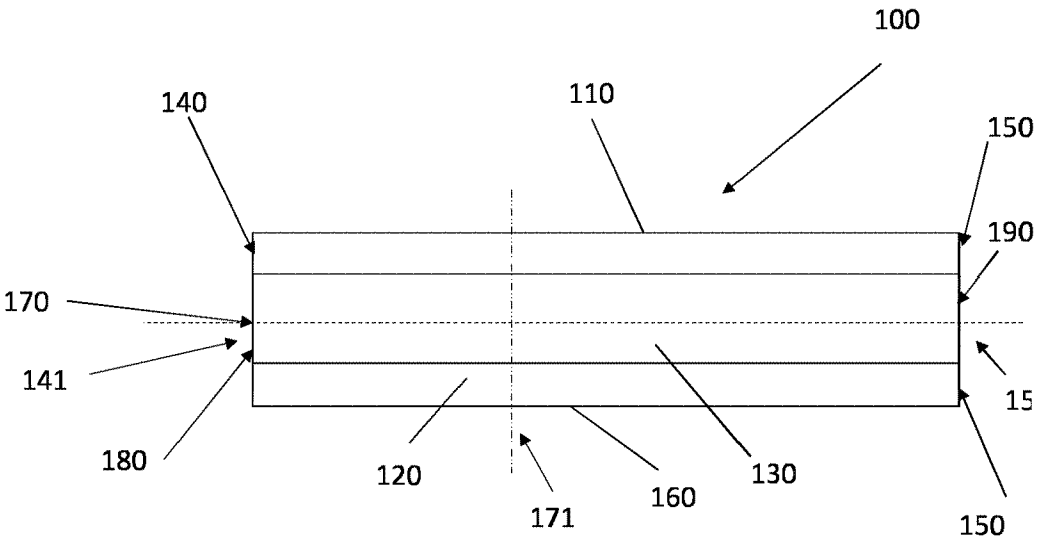
FIG. 6 is a longitudinal section of a filter component according to the invention.
Figure 5:
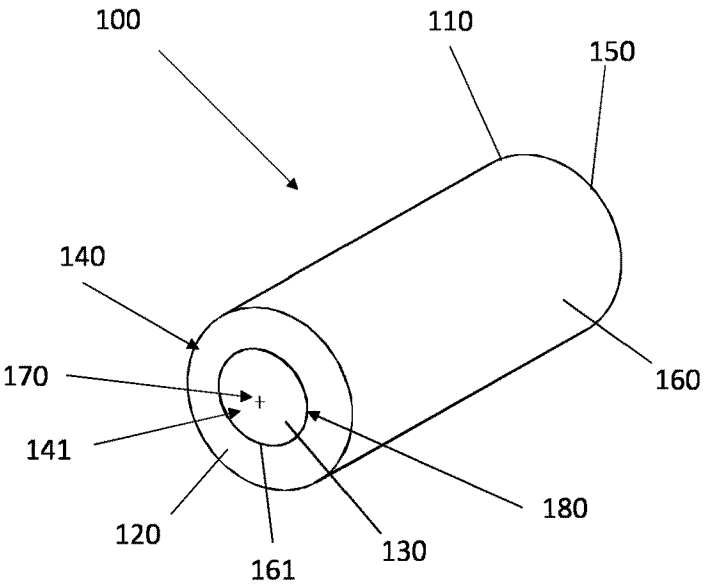
FIG. 5 is a perspective view of a filter component according to the invention

In FIG. 5 and FIG. 6 a filter component 100 realized according to the invention is shown.

Filter component 100 comprises a plug of filter material 110 comprising a body 120 of a first filtering material and at least one element 130 of a second filtering material.

The body 120 comprises first and second axially opposed first and second faces 140, 150 and it is hollow, that is, a through hole 161 defines a first and a second aperture 141, 151 formed in the first and second faces 140, 150. The body 120 is preferably cylindrical and it is formed in a synthetic material such as acetate tow. Further, the body 120 defines a cylindrical external surface, or mantle, 160, which is perpendicular to at least one of said first and a second axially opposed faces 140, 150 of said body 120.

The plug 110 defines a longitudinal axis 170, which is preferably also the axis of the cylinder defined by the body 120.

The at least one element 130 is inserted in the through hole 161 of the body 120.

As depicted in FIG. 6, said at least one element 130 preferably extends in a longitudinal direction between the first and the second axially opposed faces 140, 150. Further, preferably, the element 130 defines a longitudinal axis, coincident with axis 170. In the figures, the element 130 fills up the through hole 161 completely, that is, there is substantially no void space in the hole 161 after the element 130 insertion. Preferably, said at least one element 130 extends in a direction which is substantially parallel to the mantle 160. As depicted in FIG. 5 and FIG. 6, the component 130 includes a first and a second end 180, 190 which are flush with the corresponding first and second faces 140, 150 of said body 120.

The element 130 is a cotton yarn.

In a preferred embodiment of the invention, in the filter component 100 the ratio between the transversal dimension, that is, in a plane perpendicular to axis 170, defined by said at least one element 130 and the corresponding transversal dimension of said plug is comprised between about 0.67 and about 0.77. The plane in which the transversal dimension is taken is parallel to one of the faces 140, 150 of the body 120 and it is depicted in FIG. 6 as a dash-dotted line 171.

A volume ratio between a volume of the at least one element 130 and a volume of the plug 110 is of about 0.6 or 0.5.

Figure 7:
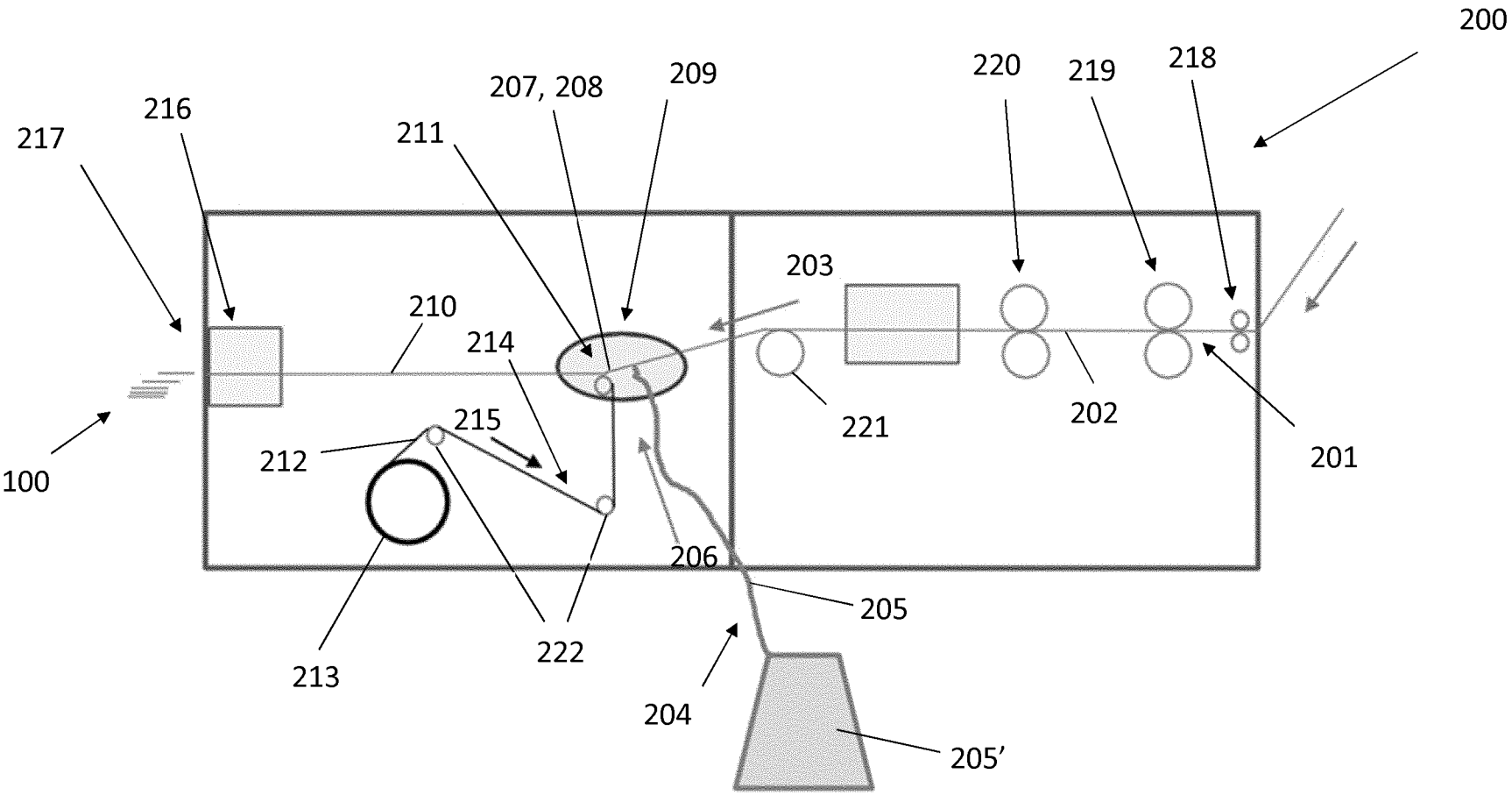
FIG. 7 is a schematic lateral cross section of the apparatus according to the invention.

FIG. 7 depicts an apparatus 200 suitable for producing the filter component 100 of the invention.

The apparatus 200 comprises a first feed path 201 adapted to continuously feed at least one layer 202 of a first filtering material along a first longitudinal transport direction 203 and a second feed path 204 adapted to continuously feed at least one strand 205 comprising at least one thread of a second filtering material along a second longitudinal transport direction 206 and intersecting said first feed path 201.

Upstream to said second feed path 205 the apparatus 200 preferably includes a supply device 205' adapted to withdraw said at least one strand 205 comprising at least one thread of a second filtering material.

Connected to a terminating end 207 of said first feed path 201 and to a corresponding terminating end 208 of said second feed path 204, the apparatus 200 includes an aligning element 209.

As depicted in FIG. 7, the first feed path 201 preferably comprises three pairs of rolls 218, 219 and 220 adapted to allow said at least one layer 202 to pass therethrough and one or more rolls 221 adapted to convoy said at least one layer 202 to the aligning device 209.

Said aligning element 209 is adapted to collect said at least one layer 202 and said at least one strand 205 and to allow said at least one layer 202 to incorporate said at least one strand 205 in such a way to form a rod 210 of filter material including a sheath of a first filtering material incorporating at least one element of at least a second filtering material.

The apparatus 200 depicted in FIG. 7 furthermore includes a wrapping station 211, included in said aligning device 209, adapted to wrap a wrapping material over the rod 210 of filter material. In FIG. 7 said wrapping material in form of a sheet 212 is withdraw by a bobbin 213 and fed to the wrapping station 211 through a third feed path 214 along a third longitudinal transport direction 215. The third feed path 214 depicted in FIG. 7 comprises a pair of rolls 222 adapted to convoy said sheet 212 to the wrapping station 211.

At a point positioned downstream to said aligning device 209, the apparatus 200 includes a forming device 216, wherein said forming device 216 is adapted to form the rod 210 of filter material into a plug 110 of filter material comprising a body 120 of first filtering material and at least one element 130 of a second filtering material, in such a way that said at least one element 130 is inserted in the body 120 of a first filtering material and that a volume ratio between a volume of the at least one element 130 of a second filtering material and a volume of the plug 110 is of about 0.6 or 0.5.

The forming device 216 depicted in FIG. 7 includes also a cutting station 217 (not represented in detail in FIG. 7) that is adapted to cut said plug 110 of filter material.

The invention claimed is:

1. A filter component comprising a plug of filter material comprising a body of a first filtering material and at least one element of a second filtering material including cotton fibers, wherein the first filtering material is different from the second filtering material, the at least one element of the second filtering material is inserted in the body of the first filtering material, and wherein a volume ratio between a volume of the at least one element of the second filtering material and a volume of the plug is comprised between 0.45 and 0.65, wherein further the filter component has a hardness comprised between 75 percent and 82 percent, the body of the first filtering material has a hardness comprised between 40 percent and 60 percent, and the at least one element of the second filtering material has a hardness comprised between 40 percent and 60 percent.

2. The filter component according to claim 1, wherein the first filtering material comprises a synthetic filtering material.

3. The filter component according to claim 1, wherein said at least one element extends in a longitudinal direction between a first and a second axially opposed faces of said body of the first filtering material.

4. The filter component according to claim 1, wherein a ratio between a traversal dimension defined by said at least one element and a corresponding transversal dimension of said plug is comprised between 0.55 and 0.89, said transversal dimension defined by said at least one element being in a direction transversal with respect to a side face of said body substantially perpendicular to at least one of said first and second axially opposed faces of said body.

5. The filter component according to claim 1, wherein said at least one element extends in a direction which is substantially parallel to a side face of the body of the first filtering material.

6. The filter component according to claim 1, wherein said at least one element extends through substantially a center of said body of the first filtering material.

7. The filter component according to claim 1, wherein at least one end of said at least one element extends flush with a corresponding face of said body of the first filtering material.

8. The filter component according to claim 1, wherein said body of the first filtering material is a hollow body and said at least one element protrudes from at least one of a first and second axially opposed faces of said body of the first filtering material.

9. The filter component according to claim 1, wherein said at least one element is one continuous element.

10. The filter component according to claim 1, wherein the second filtering material comprises vegetable fibers different from the cotton fibers.

11. The filter component according to claim 10, wherein said vegetable fibers different from the cotton fibers comprise paper fibers, polylactic acid fibers and any combination thereof.

12. The filter component according to claim 2, wherein said synthetic filtering material comprises cellulose acetate.

13. The filter component according to claim 1, wherein said first filtering material comprises at least one plasticizer.

14. The filter component according to claim 1, wherein said filter component includes a wrapping material and wherein the plug of filter material is overwrapped by the wrapping material.

15. The filter component according to claim 14, wherein said wrapping material comprises at least one sheet of paper.

16. The filter component according to claim 1, wherein said filter component comprises at least one flavor release agent.

17. The filter component according to claim 1, wherein said filter component comprises at least one dye.

18. A filter for an aerosol-generating article, wherein said filter comprises a filter component according to claim 1.

19. An aerosol-generating article, wherein said aerosol-generating article comprises a filter component according to claim 1.

* * * * *